United States Patent [19]

Narymskaya et al.

[11] 4,410,573

[45] Oct. 18, 1983

[54] BOARD MADE OF FIBROUS MATERIAL

[76] Inventors: Regina A. Narymskaya, ulitsa Orbeli, 18, kv. 23; Yakov V. Nikitin, pereulok Pirogova, 21, kv. 24, both of Leningrad; Tatyana K. Toropova, pochtovoe otdelenie "Kommunar" Tekhnichesky pereulok, 7, kv. 4, Leningradskaya oblast; Vladimir G. Ignatenko, ulitsa Spirina, 2 korpus 1, kv. 404; Jury I. Chernousov, ulitsa Marshala Kazakova, 10. korpus 1, kv. 581, both of Leningrad; Vladimir A. Chuiko, ulitsa Udaltsova, 22, kv. 51, Moscow; Mikhail T. Kalinin, ulitsa 50-letia Oktyabrya, 30, kv. 15, Arkhangelsk; Jury M. Fedotov, ulitsa Stoikosti, 35, kv. 69, Leningrad, all of U.S.S.R.

[21] Appl. No.: 384,623

[22] Filed: Jun. 3, 1982

Related U.S. Application Data

[63] Continuation of Ser. No. 243,874, Mar. 16, 1981, abandoned.

[51] Int. Cl.[3] ..... B65D 71/00

[52] U.S. Cl. ..... 428/2; 428/903.3; 428/532; 428/537

[58] Field of Search ..... 428/2, 903.3, 532, 537

[56] References Cited

U.S. PATENT DOCUMENTS

| | | | |
|---|---|---|---|
| 3,769,116 | 10/1973 | Champeau | 156/62.8 |
| 3,895,998 | 7/1975 | Haywood et al. | 162/100 |
| 3,909,470 | 9/1975 | Lambuth et al. | 260/17.3 |

FOREIGN PATENT DOCUMENTS

| | | | |
|---|---|---|---|
| 159013 | 1/1963 | U.S.S.R. | 162/DIG. 9 |
| 440468 | 1/1975 | U.S.S.R. | 162/DIG. 9 |
| 503697 | 3/1976 | U.S.S.R. | 162/DIG. 9 |

*Primary Examiner*—George F. Lesmes
*Assistant Examiner*—P. R. Schwartz
*Attorney, Agent, or Firm*—Robert E. Burns; Emmanuel J. Lobato; Bruce L. Adams

[57] ABSTRACT

Disclosed is a board made from fibrous material of vegetable origin, consisting of surface and base layers, wherein one of the base layers is made from activated sludge, the content of the components in the total mass of the board in percent by mass being as follows:

| | |
|---|---|
| fibrous material | 85–99.5 |
| activated sludge biomass | 0.5–15.0 |

The board may additionally contain a binding agent and a precipitating agent.

6 Claims, No Drawings

BOARD MADE OF FIBROUS MATERIAL

This is a continuation, of application Ser. No. 243,874, filed Mar. 16, 1981, now abandoned.

BACKGROUND OF THE INVENTION

The present invention relates to the art of fabrication of board, and more particularly to fabrication of board from fibrous material of vegetable origin. The invention can be used most advantageously in fabrication of multilayer boards, such as container board used to form smooth layers of corrugated board, box board used to make boxes for packing consumer goods and food products, ticket and innersole boards used, respectively, to make tickets and as an alternative to leather innersoles of shoes.

As is known, according to processing technique boards are classified into single-layer and multilayer ones.

Materials usable as a fibrous material for board manufacturing are cellulose, hemicellulose, wood pulp, and scrap materials. Single-layer boards are manufactured by applying a layer of pulp onto a endless wire screen of a board making machine.

Boards consisting of two and more layers are fabricated by successively applying the first and subsequent layers onto the wire screen, or by combining separate board layers made on a cylinder machine and by pressing them together, the outside layers being termed surface layers and the inside layers being termed base layers. If a board is a two-layer one, the upper layer is termed a surface layer and the bottom one is termed a base layer.

According to its composition, a single-layer board is made from a single material of vegetable origin or from a mixture of a few kinds of materials. Two-layer and multilayer boards may be made of material of the same kind or have a multicomponent composition with various relations between the components in different layers. For outside surface layers are used fine traditional materials of high quality. Materials used for base layers are materials of lower grade. The use of low-grade materials for inside layers makes it possible to decrease the consumption of high-quality fibrous materials and to cut down the cost of the board, its main properties being retained. However, fabrication of a board requires in general a substantial amount of materials of vegetable origin.

Known in the art is a multilayer board (cf. Author's Certificate of the U.S.S.R. No. 566,897, Int. Cl. D21H 1/100, 5/100, issued July 30, 1977) which contains in its surface and base layers fibrous material of vegetable origin in the amount of 98.69% by mass.

To improve physicomechanical properties of the board, into the base layers are introduced sodium aluminate and talc. However, fabrication of such a board requires only the material of vegetable origin.

Widely known are kinds of board wherein, to save costly cellulose fiber, a substantial amount thereof is substituted by scrap material.

However, scrap material represents used-up fibrous material which is also a material of vegetable origin and hence it does not solve the problem of saving this material. To this end, investigations were made to reduce the consumption of vegetable materials by substitution thereof by less costly components.

According to Author's Certificate of the U.S.S.R. No. 440,468, Int. Cl. D21H 3/100, issued Aug. 25, 1974, introduced into a pulp prior to layer forming is some amount of activated sludge which is obtained as a waste product of biological sewage treatment. Fabrication of board from the pulp containing fibrous material and sludge made it possible to obtain less costly board. However, the process of board fabrication with activated sludge introduced directly into the pulp has a number of serious disadvantages. When such a board is made on a board making machine, a substantial amount of the sludge falls through a wire screen, i.e. fabrication of the board with maximum sludge retention is rather difficult. To reduce the amount of sludge falling through the wire mesh and to intensify water removal the use of chemical agents is required. Without the use of such agents, fine sludge particles fall through the wire screen of a paper making machine. The sludge particles adsorbed on fibers impede water removal. At the same time, tray water is contaminated by suspended particles and the load on local treatment facilities is thus increased whereby the consumption of chemical agents for sewage treatment is also increased.

SUMMARY OF THE INVENTION

It is an object of the present invention to reduce the consumption of materials of vegetable origin for board fabrication.

Another object of the present invention is to utilize waste products of biological sewage treatment.

Still another object of the invention is to provide a process of board fabrication with the least possible wastes due to utilization of activated sludge of a local sewage disposal plant of the establishment.

Yet another object of the invention is to obtain a board exhibiting high physicomechanical properties.

With these and other objects in view there is provided a board made from fibrous material of vegetable origin, consisting of surface and base layers, wherein, according to the invention, one of the base layers is made completely from activated sludge, the relation between the components in the total mass of the board in percent by mass being as follows:

| | |
|---|---|
| fibrous material | 85–99.5 |
| activated sludge biomass | 0.5–15.0 |

Activated sludge biomass represents an accumulation of microorganisms taking part in the process of biological sewage treatment. In the course of biological oxidation of organic substances of sewage the activated sludge constantly increases its biomass, a portion of which should be removed from the system. That is so-called excessive sludge which is a waste product of board production. As a product of activity of microorganisms activated sludge biomass is characterized by a high protein content of 30 to 50% by mass. Due to its protein nature, the sludge may be employed in board fabrication, in particular, one of the base layers may be completely made from the sludge. A sludge layer is applied onto the layer of fibrous material of vegetable origin. The use of the sludge in board fabrication provides better cohesion between the fibers of fibrous material. This makes it possible to fabricate board having high physicomechanical properties with simultaneous utilization of activated sludge biomass which is a waste product.

The most advisable sludge content in a finished product is from 0.5 to 15% by mass. Sludge content below 0.5% provides inadequate cohesion between the fibers, and sludge content above 15% results in deterioration of dewatering properties of a paper web.

A fibrous material of vegetable origin represents wood fiber of different degree of delignification. In the process of cooking or chemimechanical treatment of wood chips lignin is removed therefrom, and according to the amount of lignin remaining in a finished product obtained are cellulose, hemicellulose, or chemical wood pulp. Groundwood pulp is obtained by mechanical treatment of materials of vegetable origin. Said fibrous materials are employed in fabrication of paper, board, and fiberboards.

Thus, when fabricating multilayer board which, as a rule, is made from a single fibrous material or from a combination of abovementioned materials, one of the base layers may be substitute by activated sludge.

It is advisable to introduce into the board made from fibrous material of vegetable origin binding and precipitating agents, the relation between the components in the total mass of the board in percent by mass being as follows:

| | |
|---|---|
| fibrous material | 55–96.5 |
| activated sludge biomass | 0.5–15.0 |
| binding agent | 0.5–20.0 |
| precipitating agent | 2.5–10.0 |

Depending on the function of the board, it may contain a binder and a precipitator in the composition. These components provide the reduction of water absorption, increase moisture resistance, and in general improve the strength properties of the board. The boards for fabrication of the articles of short-time service (boxes, tickets) are made without the use of binding agents. It is advisable to use colophonic and pitch adhesives and latexes as the binding agent, less costly pitch adhesive and latexes as an alternative to natural colophonic adhesive being more preferable.

A colophonic adhesive represents a mixture of resin acids neutralized by an alkali and suspended in water. According to the amount of the alkali introduced, the adhesive may contain a variable amount of free acids.

The introduction of the colophonic adhesive into a pulp reduces absorption of water and water solutions.

A pitch adhesive represents a stillage residue of tar oil vacuum stilling, composed of polymerized fatty and resin acids and their esters, oxyacid stearins, soap, and inorganic salts. In the course of adhesive cooking, acid components are neutralized by calcinated soda. The consumption of the pitch adhesive for board binding is higher than that of the colophonic adhesive, but its cost is substantially lower.

Papermaking industry usually employs synthetic latexes. They represent a water dispersion of polymers stabilized by surfactants. Most widely used are chlorobutadiene, chlorovinyl, butadiene-acrylonitrile, and butadiene-styrene latexes. Latexes are helpful in improving both wet and dry strength properties of the board.

Used in the board made from fibrous material of vegetable origin as a precipitator are alumina, sodium aluminate, or their mixture. Introduced in succession into the pulp from which the surface and base layers are made, except for the layer made from the sludge, are the binding agent and then the precipitator to fix the binder on the fibers, the charge of the fibers being altered therewith and the binder particles being precipitated onto the fibers.

The use of the sludge which is a waste product of biological sewage treatment for manufacturing one of the layers of the multilayer board makes it possible to save materials of vegetable origin and at the same time to improve physicomechanical properties of the board due to protein nature of the activated sludge. When introduced into the board, protein contained in the activated sludge biomass and exhibiting binding properties also makes it possible to save costly binding materials, to cut down the expenses on handling the sludge of sewage disposal plants, to eliminate introduction of chemical additives for improving water removal from a web being formed, to prevent the sludge from falling through the wire screen and, hance, to reduce the load on inshop sewage disposal plants.

To obtain high physicomechanical properties of the board, the aforementioned relation between the components is used.

DETAILED DESCRIPTION OF THE INVENTION

The board according to the invention is fabricated in the following manner. Fibrous stock fed as a liquid flow from a preparatory department is beaten on a beating equipment (a mill, a refiner) to 21°–30° SR (Schopper-Reigler degrees) according to the kind of a product produced. Thereupon, the fibrous stock is diluted with water to a concentration of 5 to 15 g/l (grams per liter), a binder and a precipitator are added and the resulting pulp is delivered for sheet forming through a discharge device which is termed a head box onto the wire screen of a board making machine. Activated sludge biomass directly from the biological sewage treatment plant of the establishment is fed with a concentration of 10 to 30 g/l after gravitational compression, or with a concentration of 30 to 50 g/l after flotation compression, into aerated accumulating reservoirs installed in the board making plant. The suspension of the activated sludge biomass is introduced between the layers of fibrous material by means of a special flow device disposed either on the wire screen of the board making machine between the head boxes of the surface and base layers, or between the forming cylinders of a cylinder board making machine. The amount of the sludge introduced by absolutely dry matter may range from 5 to 150 kg per one ton of the product obtained.

The formed layers of the web are conveyed by the moving wire screen and gradually dewatered. Thereupon, the sheet with a moisture content of 85 to 80% passes through presses of the machine wherein it is couched to a moisture content of 65 to 55%.

Then, the board sheet is dried to a moisture content of 5 to 8% in the drying part of the machine passing over heated cylinders.

It should be noted that the sludge may be employed in the board made on board making machines of different types.

The quality control of the board obtained is performed in accordance with the following factors: bursting strength, ring crushing strength, folding endurance (determined by a number of double folds), tensile strength tested on a tensile machine, and thickness as indicated by a thickness gage.

Given below are typical examples illustrating specific features of the present invention and most vividly revealing its peculiarities and advantages.

EXAMPLE 1

A board for smooth layers of corrugated board with a mass of 200 g/m$^2$ was made using the following composition in percent by mass:

| | |
|---|---|
| unbleached sulphate cellulose | 93.5 |
| activated sludge biomass | 3.0 |
| colophonic adhesive | 1.0 |
| alumina | 2.5 |

Coniferous unbleached sulphate pulp concentrated to 3% fed as a liquid flow from a preparatory department was beaten to 25° SR. Thereupon, in a special reservoir with a mixing device, introduced into the fibrous stock containing 1,018 kg of fiber by dry matter was a colophonic adhesive in the amount of 10.2 kg by dry matter with a concentration of 20 g/l which was then precipitated onto the fibers of 25.5 kg of alumina. The alumina solution had a concentration of 100 g/l. The prepared stock was fed to form the surface layers. 32.6 kg of the activated sludge biomass from sewage treatment plant agitated in the aerated accumulating reservoir with a concentration of 20 g/l by dry matter, containing 40% of protein was introduced between the surface layers. The web consisting of three layers was dewatered on the wire screen of a board making machine, pressed between rolls to a moisture content of 60%, and dried on heated cylinders to a moisture content of 8%.

Bursting strength was equal to 1,568 kPa (kiloPascals), ring crushing strength was 268 N (Newtons), and folding endurance was equal to 1,810 (see Table 1).

EXAMPLE 2

A board was made using the following composition in percent by mass:

| | |
|---|---|
| unbleached sulphate cellulose | 90.5 |
| activated sludge biomass | 6.0 |
| colophonic adhesive | 1.0 |
| alumina | 2.5 |

The consumption of the components in kg was respectively equal to 98.5, 65.3, 9.8 and 24.5.

The procedure was the same as that in Example 1.

Bursting strength was equal to 1,601 kPa, ring crushing strength was 256 N, and folding endurance was equal to 1,906 (see Table 1).

EXAMPLE 3

A board was made using the following composition in percent by mass:

| | |
|---|---|
| unbleached sulphate cellulose | 87.5 |
| activated sludge biomass | 9.0 |
| colophonic adhesive | 1.0 |
| alumina | 2.5 |

The consumption of the components in kg was respectively equal to 95.2, 98, 9.5, and 23.8.

The procedure was the same as that in Example 1.

Bursting strength was equal to 1,568 kPa, ring crushing strength was 256 N, and folding endurance was equal to 2,118 (see Table 1).

EXAMPLE 4

A board was made using the following composition in percent by mass:

| | |
|---|---|
| unbleached sulphate cellulose | 81.5 |
| activated sludge biomass | 15.0 |
| colophonic adhesive | 1.0 |
| alumina | 2.5 |

The consumption of the components in kg was respectively equal to 887, 163, 8.9 and 22.3.

The procedure was the same as that in Example 1.

Bursting strength was equal to 1,499 kPa, ring crushing strength was 253 N, and folding endurance was equal to 1,800 (see Table 1).

EXAMPLE 5 (for comparison)

A board was made in accordance with prior art technique from a composition with the following relation between the components in percent by mass:

| | |
|---|---|
| unbleached sulphate cellulose | 96.5 |
| colophonic adhesive | 1.0 |
| alumina | 2.5 |

The consumption of the components in kg by absolutely dry matter was respectively equal to 1,050; 10.9 and 27.3.

The procedure was the same as that in Example 1 with the exception of forming a layer from sludge.

Bursting strength in the reference version was equal to 1,323 kPa, ring crushing strength was 252 N, and folding endurance was equal to 1,700 (see Table 1).

Thus, the board for smooth layers of corrugated board made with the use of activated sludge in accordance with Examples 1 to 4 exhibits higher strength properties: bursting strength is increased by 13 to 21%, and ring crushing strength is increased by 0.3 to 6.3%.

TABLE 1

| Strength property | Board for smooth layers of corrugated board | | | | |
|---|---|---|---|---|---|
| | Example 1 | Example 2 | Example 3 | Example 4 | Example 5 (for comparison) |
| Bursting strength (kPa) | 1,568 (18.0) | 1,607 (21.0) | 1,568 (18.0) | 1,499 (5.6) | 1,329 |
| Ring crushing strength (N) | 268 (6.3) | 256 (1.1) | 256 (1.1) | 253 (0.4) | 252 |
| Folding endurance (a number of double folds) | 1,810 (6.64) | 1,906 (12.0) | 2,118 (24.5) | 1,800 (6.0) | 1,700 |

Note: Given in brackets is the improvement of a strength property in % as compared to the reference version.

EXAMPLE 6

A box board with a mass of 400 g/m$^2$ was made using the following composition in percent by mass:

| | |
|---|---|
| scrap material (waste paper) | 97.0 |
| activated sludge biomass | 3.0 |

Waste paper fed as a liquid flow from a preparatory department in the amount of 1,018 kg by dry matter was beaten to 22°-25° SR, diluted to a concentration of 0.3%, and supplied to the cylinder vats of the board making machine to form 5 fibrous layers of the board. 32 kg of the activated sludge biomass of sewage treatment plant agitated in the aerated accumulating reservoir with a concentration of 20 g/l, containing 40% of protein was introduced between two inside layers of the formed board web by means of a special device.

Thereupon, the board was pressed between press rolls and dried on the drying cylinders of the board making machine. Tensile strength was equal to 18.2 N, and folding endurance was equal to 55 (see Table 2).

EXAMPLE 7

A board was made using the following composition in percent by mass:

| | |
|---|---|
| waste paper | 94.0 |
| activated sludge biomass | 6.0 |

The consumption of the components in kg was respectively equal to 987 and 63.

The procedure was the same as that in Example 6.

Tensile strength was equal to 17.6 N and folding endurance was equal to 55 (see Table 2).

EXAMPLE 8

A board was made using the following composition in percent by mass:

| | |
|---|---|
| waste paper | 91.0 |
| activated sludge biomass | 9.0 |

The consumption of the components in kg was respectively equal to 955 and 95.

The procedure was the same as that in Example 6.

Tensile strength was equal to 17.2 N, and folding endurance was equal to 58 (see Table 2).

EXAMPLE 9

A board was made using the following composition in percent by mass:

| | |
|---|---|
| waste paper | 85.0 |
| activated sludge biomass | 15.0 |

The consumption of the components in kg was respectively equal to 892 and 158.

The procedure was the same as that in Example 6.

Tensile strength was equal to 16.3 N, and folding endurance was equal to 48 (see Table 2).

EXAMPLE 10 (for comparison)

A board was made in accordance with the prior art technique from waste paper. The consumption of absolutely dry fibrous material to obtain 1 ton of product was equal to 1,050 kg. The procedure of preparation was the same as that in Example 6 with the exception of forming a layer from the sludge. Tensile strength in the reference version was equal to 15.7 N, and folding endurance was equal to 47 (see Table 2).

Thus, the box board made with the use of activated sludge biomass in accordance with Examples 6 to 9, whose main strength property is tensile strength exceeds the same value of the comparisive version by 4 to 16%.

EXAMPLE 11

The board for smooth layers of corrugated board with a mass of 200 g/m$^2$ was made using the following composition in percent by mass:

TABLE 2

| Strength property | Box board Example 6 | Example 7 | Example 8 | Example 9 | Example 10 (for comparison) |
|---|---|---|---|---|---|
| Thickness (mm) | 0.6 | 0.6 | 0.6 | 0.6 | 0.6 |
| Density (g/cm$^3$) | 0.6 | 0.6 | 0.6 | 0.6 | 0.6 |
| Tensile strength (N) | 18.2 (16.0) | 17.6 (12.0) | 17.2 (10.0) | 16.3 | 15.7 |
| Folding endurance (a number of double folds) | 55 (17.0) | 56 (19.0) | 58 (23.4) | 48 (2.1) | 47 |

Note: Given in brackets is the improvement of a strength property in % as compared to the reference version.

| | |
|---|---|
| unbleached sulphate cellulose | 90.5 |
| activated sludge biomass | 6.0 |
| colophonic adhesive | 1.0 |
| alumina | 2.5 |

The procedure was the same as that in Example 1 execpt that the activated sludge biomass contained 31% of protein.

Bursting strength was equal to 1,519 kPa, ring crushing strength was 254 N, and folding endurance was equal to 1,780 (see Table 3).

EXAMPLE 12

A board for smooth layers of corrugated board was made using the following composition in percent by mass:

| | |
|---|---|
| unbleached sulphate cellulose | 90.5 |
| activated sludge biomass | 6.0 |
| colophonic adhesive | 1.0 |
| alumina | 2.5 |

The procedure was the same as that in Example 1 except that the activated sludge biomass contained 48% of protein.

Bursting strength was equal to 1,627 kPa, ring crushing strength was 263 N, and folding endurance was equal to 2,070 (see Table 3).

EXAMPLE 13 (for comparison)

A board for smooth layers of corrugated board was made using the following composition in percent by mass:

| | |
|---|---|
| unbleached sulphate cellulose | 96.5 |
| colophonic adhesive | 1.0 |

-continued

| | |
|---|---|
| alumina | 2.5 |

The procedure was the same as that in Example 1 exept for preparation of the activated sludge biomass layer. Bursting strength was equal to 1,323 kPa, ring crushing strength was 252 N, and folding endurance was equal to 1,700.

Thus, the board for smooth layers of corrugated board made with the activated sludge biomass having a different protein content in accordance with Examples 11 and 12 exhibits higher strength properties. Bursting strength is increased by 15 to 23%, and ring crushing strength is increased by 1 to 4% (see Table 3).

TABLE 3

| | Board for smooth layers of corrugated board | | |
|---|---|---|---|
| Strength property | Example 11 | Example 12 | Example 13 (for comparison) |
| Bursting strength (kPa) | 1,519 (15.0) | 1,627 (23.0) | 1,323 |
| Ring crushing strength (N) | 254 (1.0) | 263 (4.0) | 252 |
| Folding endurance (a number of double folds) | 1,780 (4.7) | 2,070 (22.0) | 1,700 |

Note: Given in brackets is the improvement of a strength property in % as compared to the reference version.

EXAMPLE 14

A box board with a mass of 400 g/m$^2$ was made using the following composition in percent by mass:

| | |
|---|---|
| waste paper | 94 |
| activated sludge biomass | 6 |

The procedure was the same as that in Example 6 except that the activated sludge biomass contained 31% of protein.

Tensile strength was equal to 16.8 N, and folding endurance was equal to 52 (see Table 4).

EXAMPLE 15

A box board with a mass of 400 g/m$^2$ was made using the following composition in percent by mass:

| | |
|---|---|
| waste paper | 94 |
| activated sludge | 6 |

The procedure was the same as that in Example 6 except that the activated sludge biomass contained 48% of protein. Tensile strength was equal to 17.8 N, and folding endurance was equal to 61. (For comparisive version see Example 10 in Table 4).

Thus, the box board made with the introduction of the activated sludge having a different protein content in accordance with Examples 7, 14 and 15 exhibits higher strength properties as compared to the board made according to prior art technique. Tensile strength is increased by 7 to 13%.

EXAMPLE 16

A board for smooth layers of corrugated board with a mass of 200 g/m$^2$ was made using the following composition in percent by mass:

| | |
|---|---|
| unbleached sulphate cellulose | 89.5 |
| activated sludge biomass | 6.0 |
| colophonic adhesive | 1.0 |
| alumina | 3.5 |

The consumption of the components in kg was respectively equal to 984, 66.3, 9.8 and 34.3.

The procedure was the same as that in Example 1. Bursting strength was equal to 1,372 kPa, ring crushing strength was 245 N, and folding endurance was equal to 1,750 (see Table 5).

TABLE 4

| | Box board | | |
|---|---|---|---|
| Strength property | Example 14 | Example 15 | Example 10 (for comparison) |
| Thickness (mm) | 0.6 | 0.6 | 0.6 |
| Density (g/cm$^3$) | 0.6 | 0.6 | 0.6 |
| Tensile strength (N) | 16.8 (7.0) | 17.8 (13.3) | 15.7 |
| Folding endurance (a number of double folds) | 52 (10.6) | 61 (29.8) | 47 |

Note: Given in brackets is the improvement of a strength property in % as compared to the reference version.

EXAMPLE 17 (FOR COMPARISON)

A board was made in accordance with prior art technique composition in percent by mass:

| | |
|---|---|
| unbleached sulphate cellulose | 95.5 |
| colophonic adhesive | 1.0 |
| alumina | 3.5 |

The consumption of the components in kg was respectively equal to 1,050; 10.5 and 36.8.

Bursting strength was equal to 1,137 kPa, ring crushing strength was 196 N, and folding endurance was equal to 1,700 (see Table 5).

Thus, the board for smooth layers of corrugated board made with the use of the activated sludge biomass in accordance with Example 16 exhibits higher strength properties: bursting strength was increased by 20%, and ring crushing strength was increased by 25%.

EXAMPLE 18

A board was made using the following composition in percent by mass:

| | |
|---|---|
| unbleached sulphate cellulose | 91.0 |
| activated sludge biomass | 6.0 |
| colophonic adhesive | 1.0 |
| alumina | 1.8 |
| natrium aluminate | 0.2 |

The consumption of the components in kg was respectively equal to 985, 65, 99, 17.8 and 0.22. The procedure was the same as that in Example 1. Bursting strength was equal to 1,421 kPa, ring crushing strength was 255 N, and folding endurance was equal to 1,900 (see Table 5).

EXAMPLE 19 (FOR COMPARISON)

A board was made in accordance with prior art technique using the following composition in percent by mass:

| | |
|---|---|
| unbleached sulphate cellulose | 97 |
| colophonic adhesive | 1 |
| alumina | 1.8 |
| natrium aluminate | 0.2 |

The consumption of the components in kg was respectively equal to 1,050; 10.5; 18.9 and 2.1. The procedure was the same as that in Example 1. Bursting strength was equal to 1.147 kPa, ring crushing strength was 216 N, and folding endurance was equal to 1.730.

Thus, the board for smooth layers of corrugated board made with the use of the activated sludge biomass in accordance with Example 18 exhibits higher strength properties: bursting strength was increased by 24%, and ring crushing strength was increased by 18% (see Table 5).

TABLE 5

| Strength property | Board for smooth layers of corrugated board | | | |
|---|---|---|---|---|
| | Example 16 | Example 17 (for comparison) | Example 18 | Example 19 (for comparison) |
| Bursting strength (kPa) | 1,372 (21.0) | 1,137 | 1,421 (24.0) | 1,147 |
| Ring crushing strength (N) | 245 (25) | 196 | 255 (18) | 216 |
| Folding endurance (a number of double folds) | 1,750 (3.0) | 1,700 | 1,900 (10.0) | 1,730 |

Note: Given in brackets is the improvement of a strength property in % as compared to the reference version.

EXAMPLE 20

A board for smooth layers of corrugated board with a mass of 200 g/m$^2$ was made using the following composition in percent by mass:

| | |
|---|---|
| unbleached sulphate cellulose | 90 |
| activated sludge biomass | 6 |
| latex | 0.5 |
| alumina | 3.5 |

The consumption of the components in kg was respectively equal to 984.4; 65.6; 4.9 and 34.3. The procedure was the same as that in Example 1. Bursting strength was equal to 1,530 kPa, ring crushing strength was 254 N, and folding endurance was equal to 1,870 (see Table 6).

EXAMPLE 21 (FOR COMPARISON)

A board was made in accordance with the prior art technique using the following composition in percent by mass:

| | |
|---|---|
| unbleached sulphate cellulose | 96 |
| latex | 0.5 |
| alumina | 3.5 |

The consumption of the components in kg was respectively equal to 1,050, 5.3 and 37.1. The procedure was the same as that in Example 1. Bursting strength was equal to 1,303 kPa, ring crushing strength was 242 N, and folding endurance was equal to 1,600.

Thus, the board for smooth layers of corrugated board made with the use of the activeted sludge biomass in accordance with Example 20 exhibits higher strength properties: bursting strength was increased by 18%, and ring crushing strength was increased by 5% (see Table 6).

EXAMPLE 22

A board for smooth layers of corrugated board with a mass of 200 g/m$^2$ was made using the following composition in percent by mass:

| | |
|---|---|
| unbleached sulphate cellulose | 77 |
| activated sludge | 6 |
| latex | 10 |
| alumina | 7 |

The consumption of the components in kg was respectively equal to 974, 76, 97.4 and 68. The procedure was the same as that in Example 1. Bursting strength was equal to 1,519 kPa, ring crushing strength was 250 N, and folding endurance was equal to 1,810 (see Table 6).

EXAMPLE 23 (FOR COMPARISON)

A board was made using the following composition in percent by mass:

| | |
|---|---|
| unbleached sulphate cellulose | 83 |
| latex | 10 |
| alumina | 7 |

The consumption of the components in kg was respectively equal to 1,050, 105 and 73.5. The procedure was the same as that in Example 1. Bursting strength in the comparisive version was equal to 1,254 kPa, ring crushing strength was 245 N, and folding endurance was equal to 1,720 (see Table 6).

Thus, the board for smooth layers of corrugated board made with the use of the activated sludge biomass in accordance with Example 22 exhibits higher strength properties: bursting strength was increased by 21%, and ring crushing strength was increased by 2%.

EXAMPLE 24

A board for smooth layers of corrugated board with a mass of 200 g/m$^2$ was made using the following composition in percent by mass:

| | |
|---|---|
| unbleached sulphate cellulose | 77 |
| activated sludge | 6 |
| latex | 10 |
| alumina | 7 |

The consumption of the components in kg was respectively equal to 974, 76, 97.4 and 85.7. The procedure was the same as that in Example 1. Bursting strength was equal to 1,529 kPa, ring crushing strength was 245 N, and folding endurance was equal to 1,790 (see Table 6).

EXAMPLE 25 (FOR COMPARISON)

The board was made using the following composition in percent by mass:

| | |
|---|---|
| unbleached sulphate cellulose | 83 |
| latex | 10 |
| alumina | 7 |

The consumption of the components in kg was respectively equal to 1,050, 105 and 73. The procedure was the same as that in Example 1. Bursting strength was equal to 1,313 kPa, ring crushing strength was 232 N, and folding endurance was equal to 1,750 (see Table 6).

TABLE 6

| Strength property | Board for smooth layers of corrugated board | | | | | | | |
|---|---|---|---|---|---|---|---|---|
| | Example 20 | Example 21 (for comparison) | Example 22 | Example 23 (for comparison) | Example 24 | Example 25 (for comparison) | Example 26 | Example 27 (for comparison) |
| Bursting strength (kPa) | 1,539 (17.9) | 1,309 | 1,519 (21) | 1,254 | 1,529 (15.8) | 1,313 | 1,225 (24) | 1,196 |
| Ring crushing strength (N) | 254 (5.0) | 242 | 250 (2.0) | 245 | 245 (5.6) | 232 | 226 (3.0) | 220 |
| Folding endurance | 1,870 (17.0) | 1,600 | 1,810 (5.2) | 1,720 | 1,790 (2.2) | 1,750 | 1,780 (11,3) | 1,600 |

Note: Given in brackets is the improvement of a strength property in % as compared to the reference version.

Thus, the board for smooth layers of corrugated board made with the use of the activated sludge biomass in accordance with Example 24 exhibits higher strength properties: bursting strength was increased by 15%, and ring crushing strength was increased by 6%.

EXAMPLE 26

The board for smooth layers of corrugated board with a mass of 200 g/m$^2$ was made using the following composition in percent by mass:

| | |
|---|---|
| unbleached sulphate cellulose | 64 |
| activated sludge biomass | 6 |
| latex | 20 |
| alumina | 10 |

The consumption of the components in kg was respectively equal to 960, 90, 192 and 96. The procedure was the same as that in Example 1. Bursting strength was equal to 1,225 kPa, ring crushing strength was 226 N, and folding endurance was equal to 1,780 (see Table 6).

EXAMPLE 27 (FOR COMPARISON)

The board was made using the following composition in percent by mass:

| | |
|---|---|
| unbleached sulphate cellulose | 70 |
| latex | 20 |
| alumina | 10 |

The consumption of the components in kg was respectively equal to 1,050, 210 and 105. The procedure was the same as that in Example 1. Bursting strength was equal to 1,196 kPa, ring crushing strength was 220 N, and folding endurance was equal to 1,600 (see Table 6).

Thus, the board for smooth layers of corrugated board made with the introduction into its composition of the activated sludge biomass according to Example 26 exhibits higher strength properties: bursting strength was increased by 24%, and ring crushing strength was increased by 3%.

EXAMPLE 28

A board for smooth layers of corrugated board with a mass of 200 g/m$^2$ was made using the following composition in percent by mass:

| | |
|---|---|
| unbleached sulphate cellulose | 90.7 |
| activated sludge biomass | 6 |
| pitch adhesive | 0.8 |
| alumina | 2.5 |

The consumption of the components in kg was respectively equal to 985, 65, 7.90 and 19.8. The procedure was the same as that in Example 1. Bursting strength was equal to 1.578 kPa, ring crushing strength was 265 N, and folding endurance was equal to 1,790 (see Table 7).

EXAMPLE 29 (FOR COMPARISON)

The board was made using the following composition in percent by mass:

| | |
|---|---|
| unbleached sulphate cellulose | 96.7 |
| pitch adhesive | 0.8 |
| alumina | 2.5 |

The consumption of the components in kg was respectively equal to 1,050, 8.4 and 26.3. The procedure was the same as that in Example 1. Bursting strength was equal to 1,343 kPa, ring crushing strength was 250 N, and folding endurance was equal to 1,750 (see Table 7).

Thus, the board for smooth layers of corrugated board made with the use of the activated sludge biomass according to Example 28 exhibits higher strength properties: bursting strength was increased by 17%, and ring crushing strength was increased by 6%.

EXAMPLE 30

A board for smooth layers of corrugated board with a mass of 200 g/m$^2$ was made using the following composition in percent by mass:

| | |
|---|---|
| unbleached sulphate cellulose | 90 |
| activated sludge biomass | 6 |
| pitch adhesive | 1.5 |
| alumina | 2.5 |

The consumption of the components in kg was respectively equal to 984, 66, 14.8 and 24.0. The procedure was the same as that in Example 1. Bursting strength was equal to 1,597 kPa, ring crushing strength was 257 N, and folding endurance was equal to 1,805 (see Table 7).

EXAMPLE 31 (FOR COMPARISON)

A board was made using the following composition in percent by mass:

| | |
|---|---|
| unbleached sulphate cellulose | 96 |
| pitch adhesive | 1.5 |
| alumina | 2.5 |

The consumption of the components in kg was respectively equal to 1,050, 15.8 and 26.3. The procedure was the same as that in Example 1. Bursting strength of the board made in accordance with the present version was equal to 1,333 kPa, ring crushing strength was 253 N, and folding endurance was equal to 1,770 (see Table 7).

Thus the board for smooth layers of corrugated board made with the use of the activated sludge biomass according to Example 30 exhibits higher strength properties: bursting strength was increased by 20%, and ring crushing strength was increased by 1.6%.

EXAMPLE 32

A board for smooth layers of corrugated board with a mass of 200 g/m$^2$ was made using the following composition in percent by mass:

| | |
|---|---|
| unbleached sulphate cellulose | 89 |
| activated sludge biomass | 6 |
| pitch adhesive | 1.5 |
| alumina | 3.5 |

The consumption of the components in kg was respectively equal to 994, 56, 14.9 and 34.8. The procedure was the same as that in Example 1. Bursting strength was equal to 1,558 kPa, ring crushing strength was 257 N, and folding endurance was equal to 1,820 (see Table 7).

EXAMPLE 33 (FOR COMPARISON)

A board for smooth layers of corrugated board was made using the following composition in percent by mass:

| | |
|---|---|
| unbleached sulphate cellulose | 95 |
| pitch adhesive | 1.5 |
| alumina | 3.5 |

The consumption of the components in kg was respectively equal to 1,050, 15.8 and 36.8. The procedure was the same as that in Example 1. Bursting strength in the comparisive version was equal to 1,362 kPa, ring crushing strength was 252 N, and folding endurance was equal to 1,790 (see Table 7).

Thus, the board made with the use of the activated sludge biomass according to Example 32 exhibits higher strength properties: bursting strength was increased by 14%, and ring crushing strength was increased by 2%.

EXAMPLE 34

A board for smooth layers of corrugated board with a mass of 200 g/m$^2$ was made using the following composition in percent by mass:

| | |
|---|---|
| unbleached sulphate cellulose | 91.2 |
| activated sludge biomass | 6 |
| pitch adhesive | 0.8 |
| alumina | 1.8 |
| sodium aluminate | 0.2 |

The consumption of the components in kg was respectively equal to 985, 65, 7.88, 17.73 and 2.0. The procedure was the same as that in Example 1.Bursting strength was equal to 1,593 kPa, ring crushing strength was 266 N, and folding endurance was equal to 1,820 (see Table 7).

EXAMPLE 35 (FOR COMPARISON)

A board was made using the following composition with the following relation between the components in percent by mass:

| | |
|---|---|
| unbleached sulphate cellulose | 97.2 |
| pitch adhesive | 0.8 |
| alumina | 1.8 |
| sodium aluminate | 0.2 |

The consumption of the components in kg was respectively equal to 1,050, 8.4, 18.9 and 0.21. The procedure was the same as that in Example 1. Bursting strength in the comparisive version was equal to 1,352 kPa, ring crushing strength was 250 N, and folding endurance was equal to 1,750 (see Table 7).

Thus, the board for smooth layers of corrugated board made with the use of the activated sludge biomass according to Example 34 exhibits higher strength properties: bursting strength was increased by 18%, and ring crushing strength was increased by 6%.

TABLE 7

| Strength property | Board for smooth layers of corrugated board | | | | | | | |
|---|---|---|---|---|---|---|---|---|
| | Example 28 | Example 29 (for comparison) | Example 30 | Example 31 (for comparison) | Example 32 | Example 33 (for comparison) | Example 34 | Example 35 (for comparison) |
| Bursting strength (kPa) | 1,578 (17.5) | 1,343 | 1,597 (20) | 1,333 | 1,558 (14) | 1,362 | 1,593 (17.8) | 1,352 |
| Ring crushing strength (N) | 265 (6.0) | 250 | 257 (1.6) | 253 | 257 (2.0) | 252 | 266 (6.4) | 250 |
| Folding endurance | 1,790 (2.2) | 1,750 | 1,805 (2.0) | 1,770 | 1,820 (1.7) | 1,790 | 1,820 (4.0) | 1,750 |

Note: Given in brackets is the improvement of a strength property in % as compared to the reference version.

Thus, the use of the sludge in accordance with the present invention makes it possible to save fibrous materials of vegetable origin in the amount of 5 to 100 kg per ton of the product obtained, to eliminate the workshop of activated sludge dewatering, and, hence, to reduce the consumption of chemical agents and electric power and to prevent land pollution with the sludge disposed to a dump. Fabrication of one of the board layers from activated sludge provides more complete retention of a portion of the sludge by the board sheet as a result of which eliminated is the sludge falling through the wire mesh and simultaneously reduced is the load on inshop sewage treatment facilities.

The use of the sludge in the board composition provides high strength properties of the product obtained.

What is claimed is:

1. A board comprising, outer layers and an inner layer, said outer layers defining outer surfaces made of a fibrous material of a vegetable origin, the inner layer being made completely of a protein-containing activated sewage sludge biomass, the content of the components in the total mass of the board in percent by mass being as follows:

| | |
|---|---|
| fibrous material of vegetable origin | 85–99.5 |
| activated sewage sludge biomass | 0.5–15.0 |

and the activated sludge biomass comprising a suspension having concentration of 10 to 30 g./l. after gravitational compression or a concentration of 30 to 50 g./l. after flotation compression upon introduction into the board for forming said inner layer.

2. A board made from fibrous material of vegetable origin according to claim 1, which further comprises a binding agent and a precipitating agent in the outer layers, the relation between the components in percent by mass being as follows:

| | |
|---|---|
| fibrous material | 55–96.5 |
| activated sludge biomass | 0.5 15 |
| binding agent | 0.5–20 |
| precipitating agent | 2.5–10 |

3. A board made from fibrous material of vegetable origin according to claim 2, wherein said binding agent is a substance chosen from the group consisting of colophonic adhesive, pitch adhesive, latex.

4. A board made from fibrous material of vegetable origin according to claim 2, wherein said precipitating agent is a substance chosen from the group consisting of: alumina, sodium aluminate or their mixture.

5. A board made from fibrous material of vegetable origin according to claim 1, in which said fibrous material is unbleached sulphate cellulose, and said board has a mass density of 200 g./m.$^2$.

6. A board made from fibrous material of vegetable origin according to claim 1, in which said fibrous material is waste paper, and said board has a mass density of 400 g./m.$^2$.

* * * * *